US007284621B2

(12) United States Patent
Sieling

(10) Patent No.: US 7,284,621 B2
(45) Date of Patent: Oct. 23, 2007

(54) GROUND LEVELLING APPARATUS

(76) Inventor: Nicolaas Laurisse Sieling, Murray-Gwynne Farm, The Coach Road, New South Wales, Mulwala (AU) 2647

( * ) Notice: Subject to any disclaimer, the term of this patent is extended or adjusted under 35 U.S.C. 154(b) by 0 days.

(21) Appl. No.: 10/509,098

(22) PCT Filed: Mar. 21, 2003

(86) PCT No.: PCT/AU03/00374

§ 371 (c)(1),
(2), (4) Date: Sep. 27, 2004

(87) PCT Pub. No.: WO03/080943

PCT Pub. Date: Oct. 2, 2003

(65) Prior Publication Data

US 2005/0161238 A1 Jul. 28, 2005

(30) Foreign Application Priority Data

Mar. 25, 2002 (AU) ..... PS1294

(51) Int. Cl.
*A01B 23/00* (2006.01)

(52) U.S. Cl. ..... 172/684.5; 172/445.1; 37/435

(58) Field of Classification Search ..... 172/684.5, 172/683, 779, 445.1; 37/268, 435
See application file for complete search history.

(56) References Cited

U.S. PATENT DOCUMENTS 3,058,243 A * 10/1962 McGee ..... 172/197
3,751,071 A * 8/1973 Patterson et al. ..... 172/679
3,908,289 A * 9/1975 Ross ..... 37/231
4,049,061 A * 9/1977 van der Lely et al. ..... 172/49.5
4,236,586 A 12/1980 Shader et al.
4,236,587 A * 12/1980 Shader et al. ..... 172/779
4,521,980 A * 6/1985 Solaja ..... 37/404
4,582,143 A * 4/1986 Pratt ..... 172/311
4,809,449 A 3/1989 Solaja
5,211,247 A * 5/1993 Johnsen ..... 172/197
5,730,229 A 3/1998 Nilsson
5,775,012 A * 7/1998 Hockensmith ..... 37/270
6,068,065 A 5/2000 Mehew et al.
6,202,328 B1 * 3/2001 Fulton ..... 37/231
6,293,352 B1 * 9/2001 Hundeby et al. ..... 172/456

* cited by examiner

*Primary Examiner*—Thomas B. Will
*Assistant Examiner*—Jamie L McGowan
(74) *Attorney, Agent, or Firm*—Young & Thompson

(57) ABSTRACT

Tractor towed ground levelling apparatus includes an elongate cutting edge mounted on a cylindrical steel beam. The beam carries road wheels and is connected to a foldable drawbar hitched to the plough arms of the tractor. Alternatively, the drawbar may be connected to the drawbar of the tractor through a height adjusting mechanism. When folded the drawbar is nestled against the beam and can be hitched to a road vehicle. The road wheels lift when the drawbar is unfolded, lowering the beam to the ground. The beam has a skid bar that skids over the ground in use. The cutting edge is mounted close to the skid bar and positioned so that its ground engaging edge is level with and parallel to the skid bar. The cutting edge is lifted or lowered by the plough arms or the height adjusting mechanism.

8 Claims, 5 Drawing Sheets

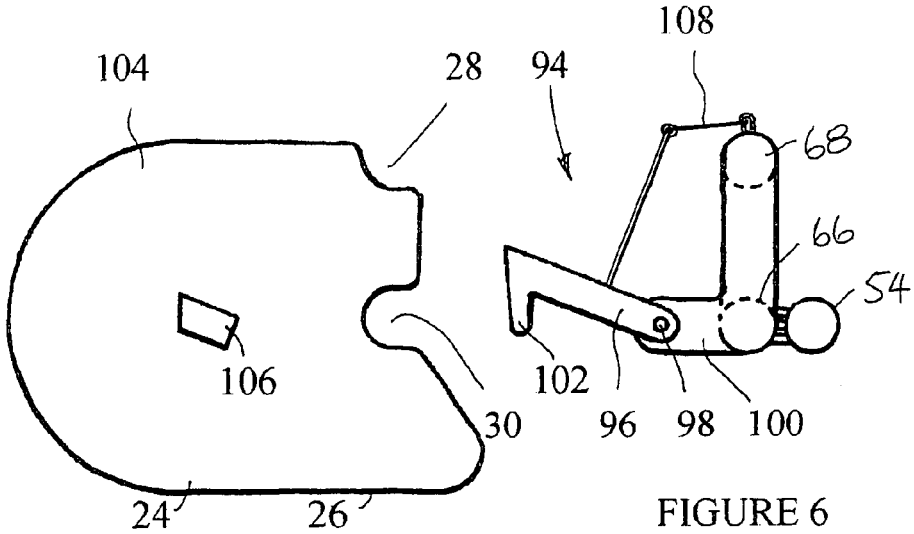
FIGURE 6
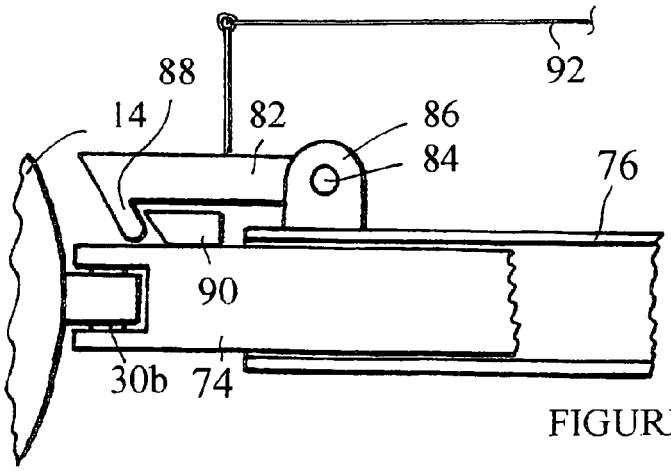
FIGURE 7
FIGURE 8
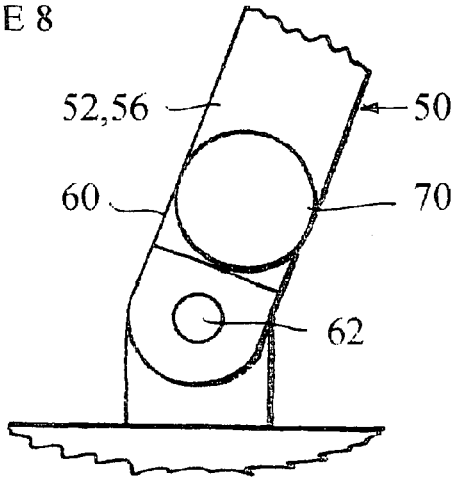

GROUND LEVELLING APPARATUS

FIELD OF THE INVENTION

This invention relates to ground levelling apparatus.

In the earth moving industry, the term "cutting edge" is commonly used to refer to a wear member that is demountably bolted or otherwise on a working edge of an implement (such as a grader blade or bucket) that cuts into the ground. In the absence of the wear member, the working edge itself would engage the ground. The wear member is designed and positioned to engage the ground instead of the working edge of the implement.

In this specification, the term "cutting edge" is used in the same sense and the term "knife edge" is used to refer more particularly to the actual ground engaging edge of the cutting edge or, in a case where no separate cutting edge is provided, the ground engaging working edge of the implement itself.

BACKGROUND OF THE INVENTION

There are a great many commercially available ground levelling machines, including such machines for use on farms. It would often not be economically justifiable for most farmers to own an industrial ground levelling machine such as a motor grader. Consequently, machines have been developed for towing behind agricultural tractors or mounting on other prime movers such as front end loaders.

In most circumstances, ground that has been levelled should be as free as possible of localised dips and rises. To this end ground levelling machines are designed so that the path of the blade in a horizontal direction remains as true as possible. A prime mover inevitably moves up and down as it traverses the ground and any implement mounted on the prime mover will move up and down with the prime mover. In fact, in the case of an implement that is hung out cantilever fashion over the front or back of a prime mover, such movement will be exaggerated. U.S. Pat. No. 4,809,449 discloses a levelling apparatus of this kind, designed to be mounted on the lift arms of a front end loader.

One way of reducing the movement of a blade carried by the implement is to suspend the blade on a frame that is supported on ground wheels at its rear end. The greater the distance between the wheel and the blade, the less will be the degree of up and down movement of the blade. U.S. Pat. No. 4,236,586 discloses a leveller with a blade assembly mounted on such a frame.

In a set up in which such a frame is not used, the implement is commonly mounted on the prime mover by a mounting arrangement actuated by one or more hydraulic rams. Often the rams are controlled manually by the driver of the prime mover. Nowadays, however, the rams can be controlled automatically, using laser level technology. Manual control is cheaper but less reliable than automatic control.

With the development of more powerful tractors has come the possibility of increasing the blade length of ground levelling machines and hence the width of the swath of earth cut by the blade in a single pass. For example, levelling machines with blades of over 10 meters in length are now commercially available. Laser level technology has also made the use of longer blades more practicable. However, the use of longer blades has some disadvantages. First, any levelling machine with such a long blade is likely to be too heavy to be hung from the front or back of a prime mover. This is particularly so since the blade must be very stiff and will therefore be heavy, if it is to remain straight in use. The apparatus shown in the aforementioned U.S. Pat. No. 4,809,449 would certainly be too heavy if it was provided with such a long blade. The commercially available levelling machines having such long blades and known to the applicant are of the type in which the blade is mounted on a wheeled supporting frame.

Second, the length of the blade is likely to cause difficulties in transporting the machine from one work place to another. One way of overcoming this problem is to provide a folding blade. One example of a long folding blade is shown in the aforementioned U.S. Pat. No. 4,236,586. However, the structure of a folding blade is inherently likely to be less rigid and straight, and more complex and expensive than a one piece blade.

SUMMARY OF THE INVENTION

According to the invention there is provided ground levelling apparatus arranged to be drawn behind a prime mover and comprising an elongate ground engaging knife edge mounted on a carrier joined to a drawbar arrangement that can be connected to the prime mover, the drawbar arrangement being arranged to position the carrier so that the knife edge is level with a bottom portion of the carrier that is parallel to the knife edge and that bears on the ground as the apparatus is drawn over the ground by the prime mover.

According to one aspect of the invention the carrier is of right circular cylindrical cross section. Advantageously, the carrier is comprised essentially of a right circular cylindrical steel pipe.

In one form of the invention the knife edge is incorporated in a cutting edge that is mounted on the carrier.

In one form of the invention the bottom portion of the carrier is provided with a wear plate for bearing on the ground.

In one aspect of the invention the drawbar arrangement comprises hitch means located adjacent its forward end for pivotably connecting the drawbar arrangement to a connection on the prime mover, the hitch means being such that carrier can remain on the ground under its own weight while the forward end of the drawbar arrangement undergoes a predetermined degree of pivotal movement in a vertical direction about the connection.

The distance between the knife edge and the connection on the prime mover is advantageously at least 12, or preferably 15, times as great as the distance between the knife edge and the bottom portion of the carrier.

In one form of the invention the knife edge is located between the bottom portion of the carrier and the connection on the prime mover.

In another aspect of the invention the carrier is joined to the drawbar arrangement in such manner as to allow the carrier to be moved relative to the drawbar arrangement between a first working position in which the carrier is disposed athwart the direction of motion of the drawbar arrangement in use, and a second working position in which the carrier is disposed substantially parallel to said direction of motion.

In one form of the invention the drawbar arrangement comprises a pair of elongate members each of which, when the apparatus is in use, projects forwardly from the carrier when the drawbar arrangement is in the first working position and has a front end and a rear end, the elongate members being spaced apart adjacent their rear ends where they are each pivotably joined to the carrier and being pivotably joined together adjacent at their front ends, means being provided to enable the elongate members to move into a disposition in which they are close together and close to the carrier when the drawbar arrangement is in the second working position.

In one form of the invention one of the elongate members is adjustable, advantageously telescopically, in length.

BRIEF DESCRIPTION OF THE DRAWINGS

The invention is further discussed with reference to the accompanying drawings in which:

FIGS. 6 and 7 are side views, on Arrows B and C in FIGS. 3 and 2 respectively, of parts of the apparatus;

FIGS. 8 and 9 are views from below and above, on Arrows D and E respectively in FIG. 1, of further parts of the apparatus;

DESCRIPTION OF EMBODIMENTS SHOWN IN THE DRAWINGS

For the sake of avoiding repetition, in this specification the use of the phrase "in the present example" or words to the same effect is intended to indicate that what is being described is by way of illustrative example and that there is no intention that the scope of the invention be limited thereto unless this appears from the context. On the other hand, there is no intention that, in the absence of a phrase of the same kind, the scope of the invention is to be limited by any matter described unless this appears from the context.

Figure 1:
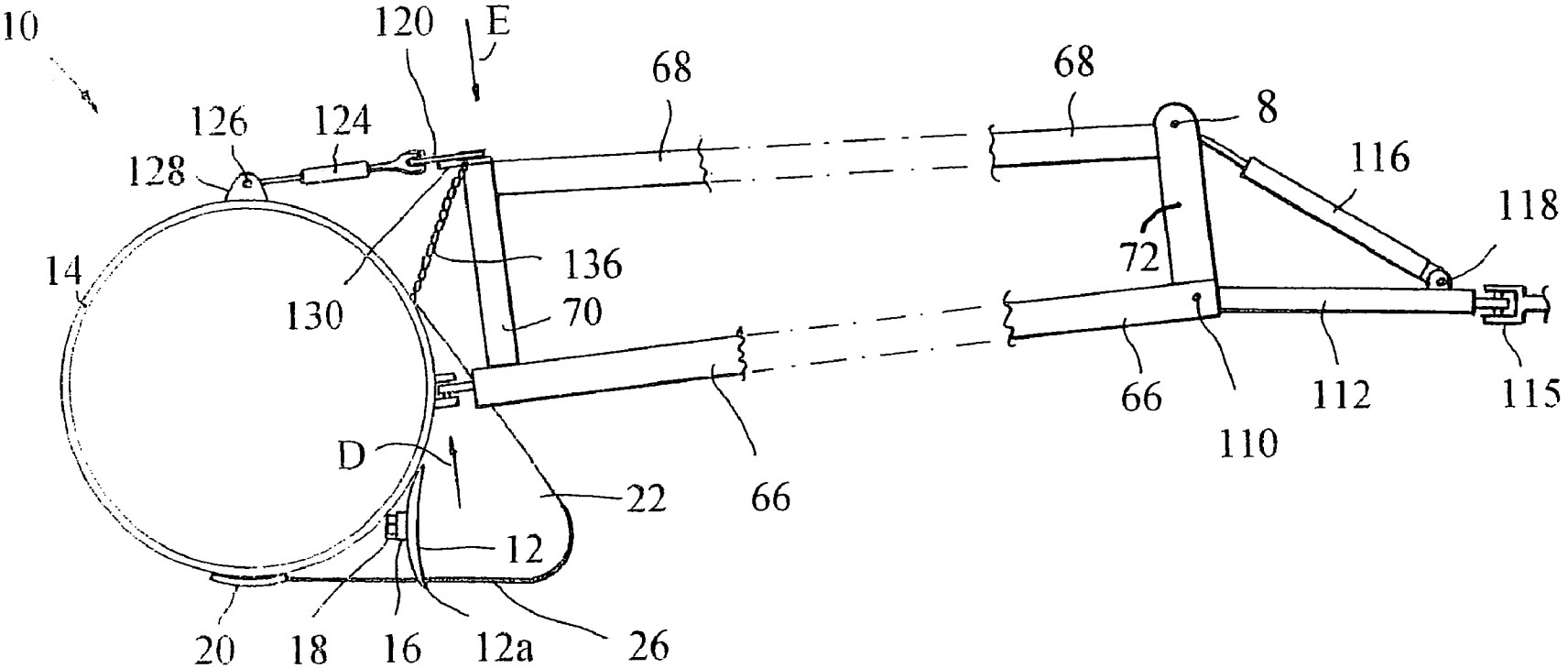
FIG. 1 is a somewhat schematic sectional side elevation of one example of a ground levelling apparatus according to the invention.

Referring first to the example shown in FIG. 1, the levelling apparatus 10 comprises a cutting edge 12 mounted on a mounting beam 14 in the form of a right circular cylindrical steel pipe. The beam is an example of what is otherwise herein called a carrier. The beam is of essentially the same length as the cutting edge so that the beam supports the cutting edge along the entire length of the latter. The cutting edge is substantially conventional except that it, and the beam, may be rather longer than usual. In the present example the length of each is in excess of 12 meters. The applicant believes that cutting edges of this length are not commercially available as a single piece so, for economy, the cutting edge 12 may be made up of, say, five shorter pieces, each of 2.4 meters length.

The cutting edge 12, or the shorter pieces of which it is made up, have each a knife edge 12*a* that engages the ground Mounting brackets 16 are welded to the beam along its length to act collectively as a seat for seating the cutting edge 12. Each bracket 16 is provided with a vertical slot (not visible in the drawing) that mates with a hole in the cutting edge 12. Mounting bolts pass through the mating slots and holes and receive nuts 18 by means of which the cutting edge 12 is fixed, in conventional fashion, on the beam. The slots allow for accurate alignment of the cutting edge.

A bar 20 of hardened steel is welded to the bottom of the beam, extending the full length thereof. The beam rests on the bar when the beam is on the ground. The bar 20 also acts as a skid on which the beam is able to slide when the beam is drawn over the ground as will be described.

Care must be taken when welding the skid bar 20 to the beam to ensure that, after welding, the skid bar is straight. Similarly, when the cutting edge 12 is being mounted on the beam, care must be taken to ensure that the knife edge 12*a* is straight and parallel to the skid bar 20. The beam must be sufficiently strong and rigid to ensure that it does not sag substantially or bend in use.

End plates 22, 24 are welded to the ends of the beam. Each end plate has a lower edge 26 that projects forwardly from the bottom of the beam in a horizontal direction. The edge slides over the ground in use. The end plates help to reduce spillage of soil past the ends of the cutting edge when the apparatus is in use. The front edge of one end plate 24 is provided with two recesses 28, 30 located one above the other. The purpose of these recesses is described below.

Figure 5:
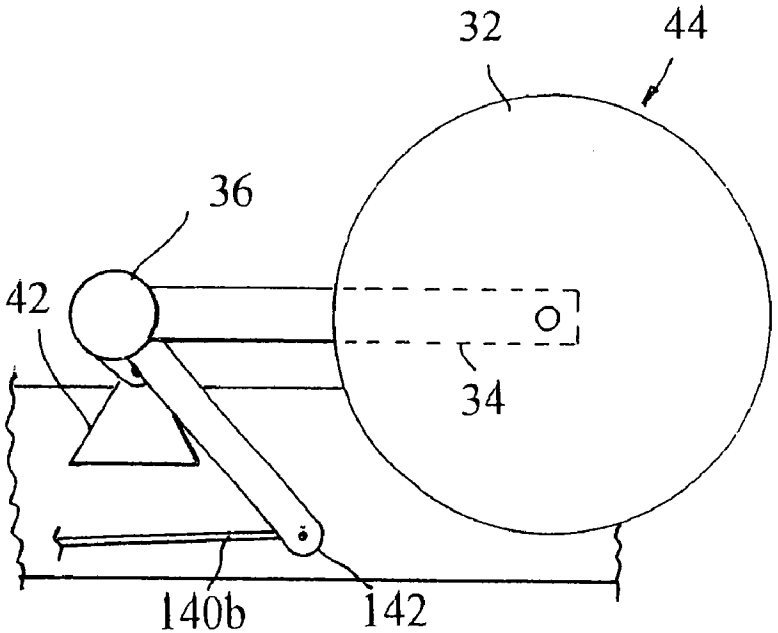
FIGS. 4 and 5 are views of the apparatus from the front, on arrow A in FIG. 2, showing a ground wheel arrangement, used for transporting the apparatus, in an unfolded (working) position and a folded position respectively.
Figure 4:
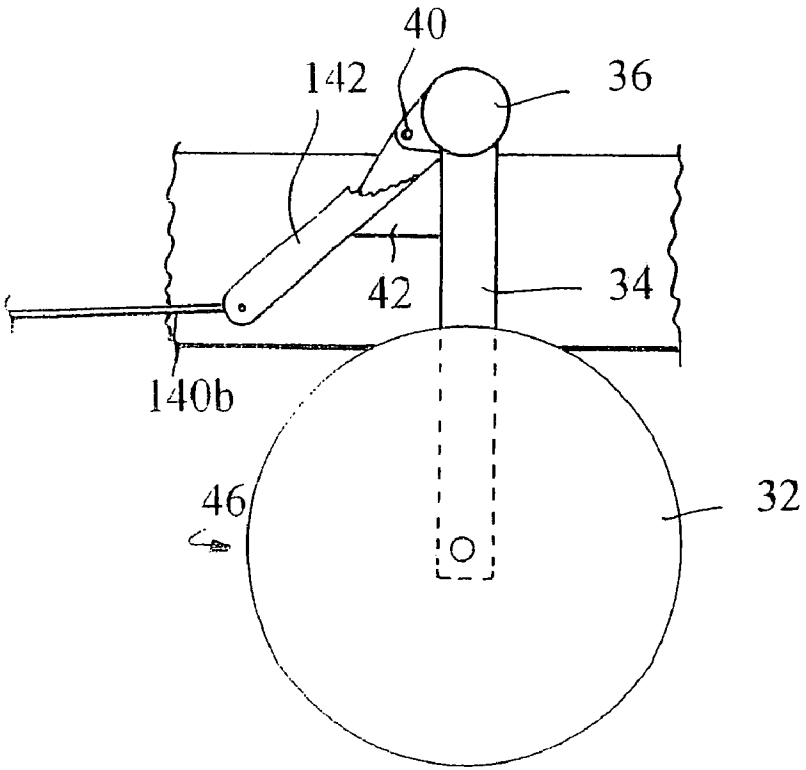
Figure 9:
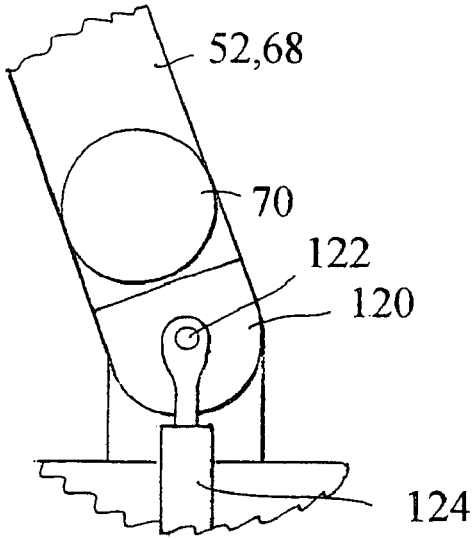

Referring to FIGS. 4 and 5, when not being used for levelling, the apparatus can be transported by means of a pair of road wheels 32. These are carried one on each of two legs 34 that are welded to a cross bar 36 to make up a fork 38. The cross bar straddles the beam so that the wheels are located one on either side of the beam. The cross bar pivots on an axle 40 mounted on trunnions 42 welded to the beam and the fork is able to pivot between a transport position, shown in FIG. 4 at 46 and a retracted position shown in FIG. 5 at 44. The mechanism that causes the fork to pivot is described below.

The apparatus also includes a foldable, triangulated drawbar assembly 50. For convenience the position of the drawbar shown in FIG. 2 will be called the 'unfolded' position and the position shown in FIG. 3 will be called the 'folded' position. The drawbar assembly comprises a pair of fabricated steel bars 52, 54 that come together at 56 adjacent the forward end of the drawbar assembly 50 where they are pivotably joined together by means of a pin 58. At their rear ends 60 the bars are spaced apart and are pivotably joined to the beam 14 by means of pins 62, 64 located one on each side of the longitudinal centre of the beam 14 and at equal distances therefrom. The axis of the pin 58 is parallel to the axes of the pins 62, 64.

The pins 62, 64 are disposed with their axes approximately vertical to the ground. The bar 52 is of fixed length and is comprised essentially of two steel pipes 66, 68 located one above the other and joined together by spaced members of which only two 70, 72 are visible in the drawing and are discussed in greater detail below.

The bar 54 also comprises two steel pipes 74, 76. However, in this case, the pipe 74 slides telescopically into the pipe 76. The pipe 76 pivots about the pin 58. The lengths of the pipes 74, 76, and the arrangement of the pins 62, 64, 58 is such that the bar 52 is able to pivot about the pin 62 from the position shown in FIG. 2 to the position shown in FIG. 3. In this movement, the pipe 74 slides out of the pipe 76, effectively increasing the length of the bar 54. In the unfolded position the two pipes 74, 76, one inside the other, make the bar 54 substantially rigid. In the unfolded position the beam 14 is disposed athwart the direction of motion of the drawbar assembly when the apparatus is being drawn forward by a tractor in a ground levelling operation. In the folded position the beam is disposed substantially in line with the direction of motion of the drawbar assembly when the apparatus is being moved by a tractor or other prime mover, for example from one work place to another.

A first latch arrangement 80 (located adjacent the intersection between the pipe 74 and the beam 14 and shown in FIG. 7) is provided to lock the two pipes 74, 76 together when the drawbar assembly is in the unfolded position. This latch arrangement comprises a latch member 82 that pivots about a pin 84 mounted between a pair of trunnions 86. The trunnions are welded to the pipe 76 close to the rear end thereof. The latch member 82 has a hook formation 88. A catch member 90 is welded to the pipe 74 close to the rear end thereof and in line with the latch member. As the pipe 76 moves to the unfolded position, the latch member rides over the catch member and drops under its own weight into the position shown in FIG. 7 with the hook formation engaging the catch member. The latch member can be lifted out of engagement with the catch member by a drawstring 92 led to the cab of the prime mover, as will be described.

Figure 3:
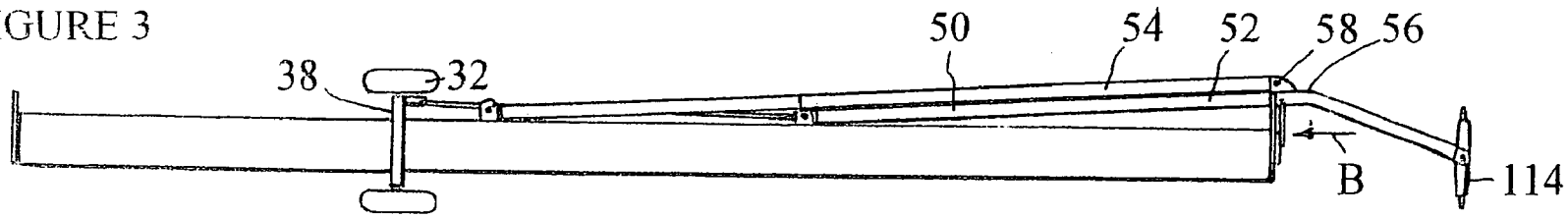

A second latch arrangement 94 is mounted on the bar 52 and engages the end 34 of the beam 14 to lock the two bars 52, 54 to each other and to the end 34 of the beam when the drawbar assembly 50 is in the folded position shown in FIG. 3. As shown in FIG. 6, the second latch arrangement 94 comprises a latch member 96 that pivots about a pin 98 mounted on a trunnion 100 welded to the lower pipe 66 of the bar 52. A hook formation 102 is formed in the latch member 96. The location of the trunnion is chosen so that, when the bar 52 moves to the folded position, the trunnion carries the latch member 96 across the outer face 104 of the end plate 24 of the beam. In this movement the pipes 66, 68 move into the respective recesses 28, 30 of the end plate 24 and the latch member 96 rides over a catch member 106 welded to the outer face and drops under its own weight into a position in which the hook formation 98 engages the catch member 106. This second latch arrangement 94 locks the pipes 66, 68 in the recesses of the end plate 24. The bars 52, 54 and the beam are also thus locked together against vertical movement, allowing the drawbar assembly to lift the end 14*a* of the beam for transport as will be described. The latch member 96 can be lifted out of engagement with the catch member 106 by a drawstring 108 led to the cab of the prime mover.

When the drawbar assembly 50 is in the unfolded position, without leaving his seat, the driver pulls the drawstring 94 to unlock the latch member 82. The driver can then manoeuvre the tractor in a roughly circular path, to move the drawbar assembly 50 to the folded position. In this movement, the end 14*a* of the beam sits firmly on the ground and the bar 52 pivots about the pin 62. The bar 54 pivots about the pin 64, extending in length telescopically in the process. When the drawbar assembly arrives at the folded position, the latch member 92 automatically locks the two bars 52, 54 against the beam 14.

The driver can also, again without leaving his seat on the tractor and by pulling the drawstring 108, unhook the latch member 96 and thereby release the drawbar assembly from its folded position. Using the tractor, the driver can then, again driving in a roughly circular path, move the drawbar assembly back to the unfolded position in which it is automatically locked by the latch member 82.

Figure 2:
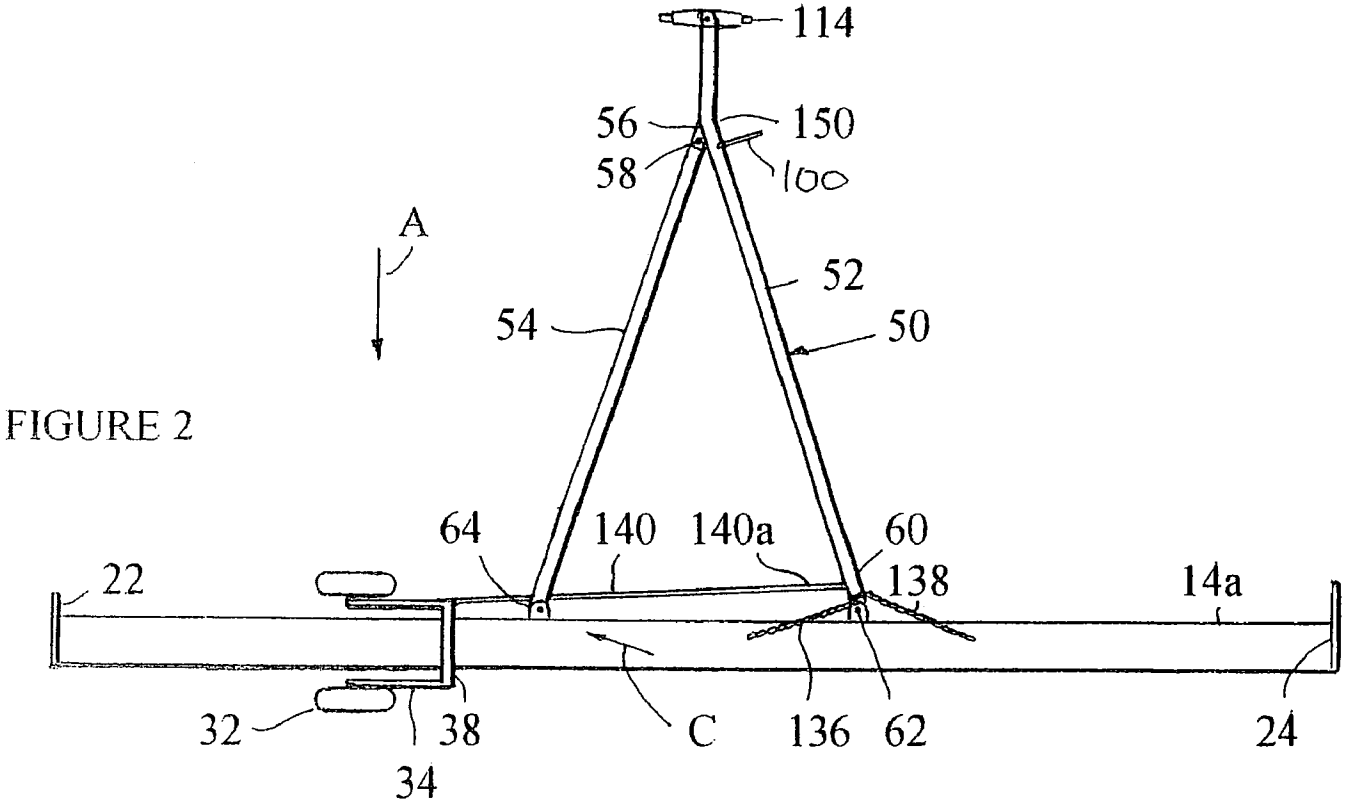
FIGS. 2 and 3 are plan views of the apparatus showing respectively a drawbar thereof in an unfolded (working) position and a folded position, used in transporting the apparatus.

As shown in FIGS. 2 and 3, a conventional hitch bar is mounted at the forward end of the drawbar assembly 50 for connecting the apparatus to the two lower links (plough arms) of the three point hitch (not shown) of a tractor. The forward end of the drawbar assembly can thus be raised or lowered simply by raising or lowering the plough arms. For tractors that do not have plough arms, the modification shown in FIG. 1 may be used. Here, the forward end of the bar 52 is connected through a pivot pin 110 to a rigid fore-and-aft extending towbar 112. The forward end of the towbar is provided with a conventional eye by means of which it can be hitched to the drawbar 115 of a tractor. A hydraulic ram 116 is connected at one end to the towbar 112 through a pin 118 and at its opposite end to the upper end of the upright 72 of the drawbar assembly through a pin 8. By this means the towbar 112 is held in a fixed position relative to the drawbar assembly 50 which can be raised or lowered by actuation of the ram 116.

If the levelling apparatus is to be used on a tractor without plough arms, the bottle screw 116 can be replaced by a ram that is connected to the hydraulic system of the tractor and is controllable by the driver. The hitch bar 114 is omitted and the towbar 112 is connected to the towing hitch of the tractor. Operation of the ram causes the forward end of the drawbar assembly 50 to be raised or lowered.

As already described, the bar 52 in the present example is comprised of a vertically disposed frame made up of the pipes 66, 68 and the uprights therebetween (including the uprights 70, 72). The bar must be strong enough to withstand the considerable forces applied to it in use. The joint between the bar 52 and the beam 14 must be rigid and at the same time allow the bar to pivot between the folded and unfolded positions. To this end a first plate 120 is welded to the extreme upper end of the upright 70. The plate 120 is positioned so that a predrilled hole 122 therein is in alignment with the axis of the pin 62.

One end of a bottle screw 124 is anchored in the hole 122. The opposite end of the bottle screw is pivoted to a horizontally disposed pin 126 carried by a pair of trunnions 128 standing up from the beam, being welded thereto at a position directly behind the upright 70. If the drawbar assembly is assumed to be held in a fixed position, adjustment of the length of the bottle screw causes the beam to rotate about its own longitudinal axis relative to the drawbar assembly. Once set and held in position as will be described, the bottle screw prevents the beam from further such relative rotation. This is important because, for reasons which will be explained, when the apparatus is being used in a levelling operation, the elevation above the ground of the knife edge 12*a* relative to the skid bar 20 should be controlled solely by raising or lowering the forward end of the drawbar assembly 50. This would not be possible if the beam was able to rotate freely relative to the drawbar assembly.

Figure 10:
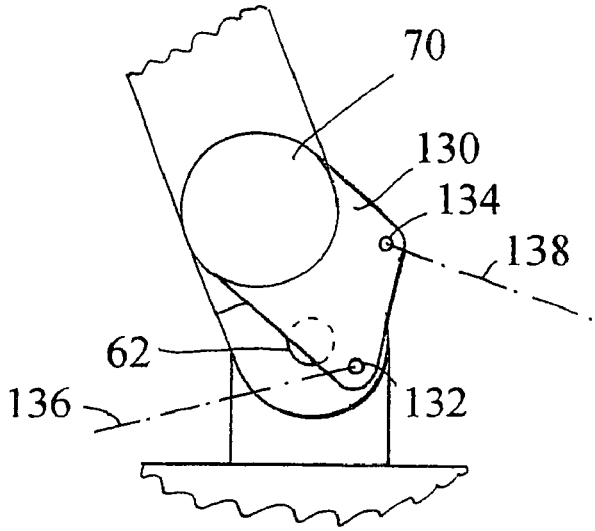
FIG. 10 is a view from above, also on Arrow E in FIG. 1 of yet another part of the apparatus but with a plate 120 removed.
Figure 11:
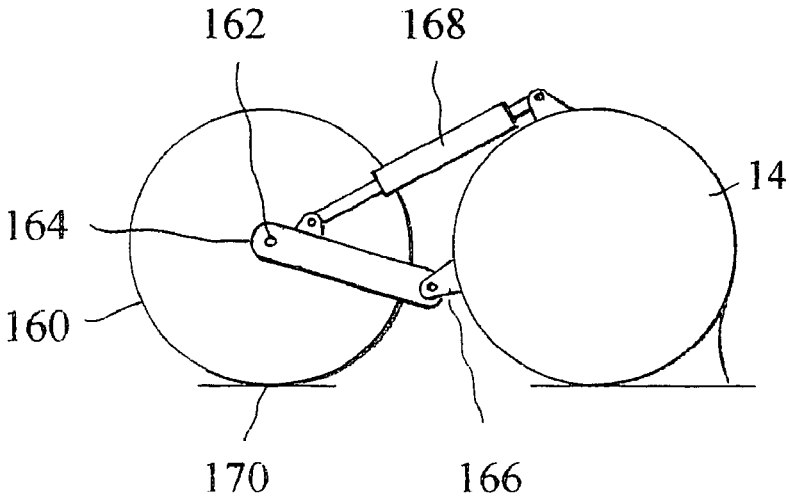
FIG. 11 is a schematic side view of a wheel arrangement that can be fitted to the apparatus.

A second plate 130, provided with two holes 132, 134 is welded to the upright 70 at a short distance below the plate 120. The upper ends of two link chains are connected to the respective holes 132, 134. For clarity the chains are shown only as lines 136, 138. The lower ends of the chains are connected to the beam, one on either side of the upright 70. As shown in FIG. 10, the hole 132 is positioned so that, as the bar 52 moves from the folded position to the unfolded position, the hole 132 moves from the left to the right of the axis of the pin 62. The hole 134 is located to the right of the axis of the pin 62 and is positioned so that it moves further away from the beam as the bar 52 moves from the folded position to the unfolded position. This positioning of the holes 132, 134 has the result that, when the drawbar assembly is in the unfolded position the chains can be set up taut; however, they become slack when the drawbar assembly moves to the folded position. In the unfolded position, the chains and the bottle screw 124 serve to brace the upright 70 and help reduce twisting of the beam about a line extending in the direction of motion of the apparatus. Excessive twisting of this kind would cause the beam to rotate about its longitudinal axis, through the action of the bottle screw. This is undesirable for reasons already mentioned. The bottle screw alone would be unable to prevent such twisting.

When the apparatus is to be used, the wheels are locked in the retracted position 44 and the drawbar assembly is locked in the unfolded position by the latch arrangement 80. The forward end of the drawbar assembly is hitched to the plough arms of the tractor and thus supported above the ground. The mechanism for moving the wheels between the retracted position and the transport position includes a bar 140. One end 140*a* of the bar 140 is pivotably connected to the bottom of the pipe 66 at a short distance from the pin 62. The opposite end 140*b* of the bar 140 is pivotably connected to a lever 142 welded to the cross bar 54 of the fork that carries the wheels. When the drawbar assembly is moved to the unfolded position, the bar 52, acting through the bar 140, causes the fork to rotate to move the wheels to the retracted position. When the drawbar assembly is moved to the folded position, the opposite happens; i.e. the bar 52, again acting through the bar 140, causes the fork to rotate to move the wheels to the transport position.

When the wheels 32 are in the transport position, the drawbar assembly 50 is in the folded position, nestled against and locked to the beam by the latch arrangement 94. The beam is lifted off the ground, supported by the wheels and the drawbar assembly hitched to the tractor. In this configuration, the tractor can tow the apparatus to a new work place. The beam is disposed with its axis in line with the direction of motion of the tractor. This is very convenient for towing the apparatus. If either the beam or the drawbar assembly was disposed athwart the direction of motion of the tractor during transport, the apparatus would not be allowed on public roads without special permission.

The bar 52 is cranked as shown at 150 to ensure that the apparatus is correctly lined up behind the tractor in use and also behind the towing vehicle when it is being transported.

In a levelling operation, the height of the forward end of the drawbar assembly is adjusted (by lowering or raising the plough arms of the three point hitch), causing the beam to rotate about its longitudinal axis until the skid bar 20 and the knife edge 12*a* of the cutting edge 12 are level with each other. This is what may be described as the "normal" working position of the knife edge relative to the skid bar and to the level of the ground. The applicant has found that levelling with this as well as with conventional levelling apparatus, levelling is optimal when a bank of earth of chosen height, typically about 10 cm, is maintained just ahead of the cutting edge. The height of this bank may vary depending on the condition of the soil. The operator must control the apparatus to maintain the bank at the chosen height. If the operator sees that the height of the bank is increasing, he must cause the elevation of the knife edge (relative to the ground) to be raised. This allows more soil to escape under the knife edge and causes the height of the bank to diminish slowly. If the height of the bank decreases below the chosen height, the operator must cause the elevation of the knife edge to be lowered to allow less soil to escape under the knife edge.

In the present apparatus the elevation of the knife edge is controlled simply by raising or lowering the plough arms of the tractor and hence the drawbar assembly 50 at the hitch 114. In the present example the length of the drawbar assembly from the hitch bar to the pins 62, 64 is about 7 m. A substantial advantage of the present invention is that this length is much greater than the distance between the skid pad 20 and the knife edge 12*a* (equal in the present example to about 225 mm). The ratio of these distances is about 30:1. Thus, if the three point hitch raises the hitch 114 by 30 mm, the elevation of the knife edge, relative to the skid pad 20, is raised by only 1 mm. A differential of 30:1 in changes of the respective elevations enables the levelling operation to be very finely controlled.

It may be advantageous to provide the levelling apparatus with pairs of auxiliary wheels, shown schematically at 160, located behind and adjacent each end of the beam 14. Each pair of wheels may be carried on axles 162 mounted on arms 164. The arms are pivotably mounted at their inner ends on trunnions 166 welded to the beam 14. The outer ends of the arms are connected to the beam by bottle screws 168. These are used to adjust the position of the arms so that, in a normal levelling operation, the bottom points 170 of the wheels are level with the skid bar and the knife edge 12*a*, i.e. just touching the ground. If the front end of the drawbar assembly is now lifted, the beam 14 is lifted off the ground. This is useful for at least two reasons. It enables the cutting edge to be lifted over any earth piled in front of the cutting edge at the end of a pass. It also enables the apparatus to be moved quickly from one place to another in a work area. However, it is not intended that the wheels should be used to support the beam above the ground in a normal levelling operation. It is important that the beam should be in contact with the ground over substantially the entire length of the skid bar. This much reduces any tendency of the beam to sway up or down at its ends, to dig into the ground along its entire length or to bounce up and down. These advantages would be lost if the beam was supported above the ground by the wheels.

In the present example, the ratio of the length of the drawbar assembly to the distance between the knife edge 12*a* and the point 170 is about 10:1. The applicant has operated the apparatus described herein experimentally with the beam lifted off the ground by the wheels 160 and has found that, apart from the disadvantages mentioned above, the fine control of the position of the cutting edge is clearly diminished. Although the judgement is subjective, based on this experience, the applicant considers that the ratio of the length of the drawbar assembly to the distance between the skid bar 20 and the knife edge 12*a* should not be less than about 15:1 and certainly not less than 12:1.

It is not essential that the road wheels 32 be attached to the beam. If they are omitted, the apparatus can be supported on a separate dolly for transport.

The invention claimed is:

1. A ground leveling apparatus arranged to be drawn behind a prime mover and comprising:

a ground engaging knife edge mounted on an elongate carrier joined to a drawbar arrangement that is rigid between a forward end at which first connecting means is provided for pivotally connecting the drawbar arrangement to the prime mover and a rear end at which second connecting means is provided for connecting the drawbar arrangement to the carrier, the second connecting means being such that the carrier is unable to rotate axially with respect to the drawbar arrangement, the carrier having a bottom portion that is parallel to the knife edge and that bears on the ground when the apparatus is in the first working position and skids over the ground as the apparatus is drawn over the ground by the prime mover, the drawbar arrangement being arranged to position the carrier so that the knife edge is level with the bottom portion and being such that the carrier remains on the ground under its own weight while the forward end of the drawbar arrangement undergoes a predetermined degree of pivotal movement in a vertical direction about the connection, wherein a ratio of a first distance between the forward end and the rear end of the drawbar to a second distance between the bottom portion of the carrier and the knife edge is not less than twelve, whereby when the forward end of the drawbar moves vertically a third distance the knife edge moves in a same vertical direction a fourth distance that is the third distance times an inverse of the ratio.

2. The apparatus according to claim 1, wherein the knife edge is incorporated in a cutting edge that is mounted on the carrier which is comprised of a member of right circular cylindrical cross section, the drawbar arrangement comprising a pair of elongate members each of which has a rear end and a forward end and which, when the apparatus is in use, projects forwardly from the carrier when the drawbar arrangement is in a first working position, the elongate members being spaced apart adjacent at their rear ends where they are each pivotally joined to the carrier and being pivotally joined together adjacent their forward ends, means being provided to enable the elongate members to move into a disposition in which they are close together and close to the carrier when the drawbar arrangement is in a second working position.

3. The apparatus according to claim 2, wherein the bottom portion of the carrier is provided with a wear plate for bearing on the ground.

4. The apparatus according to claim 1, for use with a prime mover equipped with towing means comprising a three point hitch that includes a pair of plough arms, wherein the drawbar arrangement comprises means for connecting the drawbar arrangement to the plough arms.

5. The apparatus according to claim 1, for use with a prime mover equipped with towing means comprising a tow bar, wherein the drawbar arrangement comprises means for pivotally connecting the drawbar arrangement to the tow bar, and means for lifting and lowering the forward end of the drawbar arrangement through a predetermined degree of movement in a vertical direction.

6. The apparatus of claim 1, wherein the ratio is not less than fifteen.

7. The apparatus of claim 1, wherein the ratio is about thirty so that the third distance is about thirty times the fourth distance.

8. The apparatus of claim 7, wherein the first distance is about seven meters.

* * * * *